US010583975B2

(12) United States Patent
Flynn

(10) Patent No.: US 10,583,975 B2
(45) Date of Patent: Mar. 10, 2020

(54) CARGO SMART WALL

(71) Applicant: INDIE DWELL INC., Boise, ID (US)

(72) Inventor: Scott Flynn, Boise, ID (US)

( * ) Notice: Subject to any disclaimer, the term of this patent is extended or adjusted under 35 U.S.C. 154(b) by 86 days.

(21) Appl. No.: 15/783,974

(22) Filed: Oct. 13, 2017

(65) Prior Publication Data

US 2018/0105342 A1 Apr. 19, 2018

Related U.S. Application Data

(60) Provisional application No. 62/407,876, filed on Oct. 13, 2016.

(51) Int. Cl.

| | |
|---|---|
| ***E04B 1/08*** | (2006.01) |
| ***B65D 81/05*** | (2006.01) |
| ***B65D 81/02*** | (2006.01) |
| ***E04B 1/348*** | (2006.01) |
| ***B65D 90/02*** | (2019.01) |
| ***E04B 1/14*** | (2006.01) |

(52) U.S. Cl.

CPC ..... *B65D 81/055* (2013.01); *B65D 81/025* (2013.01); *B65D 90/022* (2013.01); *E04B 1/08* (2013.01); *E04B 1/14* (2013.01); *E04B 1/34853* (2013.01); *E04B 1/34861* (2013.01); *B65D 81/051* (2013.01)

(58) Field of Classification Search

CPC ..... B65D 81/055; E04B 1/08; E04B 1/34861; E04B 1/34853; Y10T 29/49616; Y10T 29/49629; Y10T 29/49632; Y10T 29/49623; Y10T 29/49627

See application file for complete search history.

(56) References Cited

U.S. PATENT DOCUMENTS

| | | | |
|---|---|---|---|
| 4,299,065 | A | 11/1981 | Fairgrieve |
| 4,644,708 | A | 2/1987 | Baudot et al. |
| 4,854,094 | A | 8/1989 | Clark |
| 4,882,883 | A | 11/1989 | Horn |
| 4,899,018 | A | 2/1990 | Sireci |
| 5,341,615 | A | 8/1994 | Hodges et al. |
| 5,357,055 | A | 10/1994 | Sireci |
| 5,706,614 | A | 1/1998 | Wiley, Jr. et al. |
| 5,886,295 | A | 3/1999 | Carino et al. |
| 6,508,043 | B1 | 1/2003 | Bond et al. |
| 6,675,540 | B1 | 1/2004 | Rokes |
| 8,397,441 | B2 | 3/2013 | Wallance |
| 8,595,988 | B2 | 12/2013 | Fernandez |
| 2003/0188507 | A1 | 10/2003 | Cote, Jr. |

(Continued)

OTHER PUBLICATIONS

"Shipping Container Homes," www.countainerhomes-info.com, Apr. 24, 2015, accessed Jul. 26, 2018.

(Continued)

*Primary Examiner* — Jason L Vaughan
*Assistant Examiner* — Amanda Kreiling
(74) *Attorney, Agent, or Firm* — Shaver & Swanson, LLP; Scott D. Swanson

(57) ABSTRACT

A method for forming a structural wall section by sandwiching a corrugated metal panel between correspondingly corrugated EPS inner and outer panels. Also disclosed is a structural wall formed from a corrugated metal wall sandwiched between inner and outer EPS panels with a corrugated side on each of the EPS panels engaged with the corrugated metal panel.

6 Claims, 7 Drawing Sheets

(56) References Cited

U.S. PATENT DOCUMENTS

| | | | | |
|---|---|---|---|---|
| 2006/0117689 | A1* | 6/2006 | Onken | E04C 2/22 52/309.7 |
| 2009/0056255 | A1* | 3/2009 | Barton | E04B 1/14 52/309.7 |
| 2010/0300012 | A1* | 12/2010 | Beavers, Jr. | E04B 1/14 52/79.1 |
| 2011/0232202 | A1* | 9/2011 | Graf Fernandez | E04B 1/34853 52/79.1 |

OTHER PUBLICATIONS

RSCP + KOOP.am LLC, "Residential Shipping Container Primer", www.residentialshippingcontainerprimer.com, 2002-2017, accessed Jul. 26, 2018.

Chambers, Paul, "Build Shipping Container House," www.buildshippingcontainerhouse.com, 2013; accessed Jul. 26, 2018.

Container Technology Inc., "Insulation—Interior Finishing," www.containertech.com, 2018; accessed Jul. 26, 2018.

greenhomebuilding.com, "Building with Shopping Container," www.greenhomebuilding.com; accessed Jul. 26, 2018.

EZ SIPS, "EZ SIPS Build-in-Place Structural Insulated Panels—A breakthrough ultra low-cost green way to frame and super-insulate in one step," www.structuralinsulatedpanels.com, 2018; accessed Jul. 26, 2018.

Insofast, "A Discussion about Insulating Shipping Containers," www.insofast.com, May 5, 2015; accessed Jul. 26, 2018.

SIPA—Structural Insulated Panel Association, "Frequently Asked Questions (FAQs) Regarding Structural Insulated Panels (SIPs)," www.sips.org/about/frequently-asked-questions-faqs-regarding-structural-insulated-panels-sips, 2018; accessed Jul. 26, 2018.

* cited by examiner

CARGO SMART WALL

PRIORITY/CROSS-REFERENCE TO RELATED APPLICATION

This application claims the benefit of U.S. Provisional Application No. 6240786, filed Oct. 13, 2016, the disclosure of which is incorporated by reference.

TECHNICAL FIELD

The presently disclosed and claimed inventive concept(s) generally relates to a method for constructing a structural wall, and more particularly to a method of insulating the walls of a cargo trailer.

BACKGROUND

Goods are shipped all over the world using rectangular steel shipping containers. The shipping container is generally standardized at 20 or 40 feet long, 8-9.5 feet tall, and 8 feet wide, with the walls made of corrugated steel typically 14 gauge thick. The corrugations are also standardized and are angular, with flat peaks and valleys and angled sections joining the flat regions. Excess shipping containers are available for a modest price, and there is great interest in using them as buildings such as sheds, garages, bans, storage rooms, as small houses, or joined in multiples to form larger houses.

A problem with using shipping containers as a house is that the steel wall readily conducts heat or cold. A feature of the shipping container is that it is waterproof, which can be good or bad. When using a shipping container as a house the user typically insulates the wall for comfort. One way to insulate the wall of the shipping container is to attach 2×4 studs to the inside of the wall, and place fiberglass insulation batting between the studs, in the same manner that conventional houses are insulated. A disadvantage of this method is that the process usually involves drilling holes in the shipping container walls for securing the studs. A big disadvantage is that this method basically requires building a stud wall inside the steel wall, thereby negating the benefit of already having a structural wall available. One might as well just build a stick built house in such a case, and forego the shipping container. Drilling holes in the steel wall has the disadvantage of introducing sites of water leakage and rust into the wall, thus decreasing the lifespan of the shipping container. This method of insulating a shipping container is labor intense, and it would be desirable to simplify the process.

Another method of insulating the shipping container wall is to use spray on foam for form an inner coating. The foam forms a rough uneven surface, and is generally unsightly. One way to overcome this is to first attached studs or firring strips to the inner surface of the container wall, and use the edges of the firring strips to smooth the spray on foam.

Another way to insulate the walls of the shipping container is to attach sheets of extruded polystyrene (Styrofoam) to the corrugated steel. The problem with this is that the process leaves air spaces or voids in the corrugations, which can be a source of humidity, rust and mold.

An improved method would be less labor intensive, fill all voids in the corrugations, and not result in penetrations or drilling of the steel container walls.

SUMMARY OF THE DISCLOSURE

To solve the problems noted in the background section, the present invention is a method of forming a three layer structural wall in one case. It is also a method of insulating a corrugated metal wall of a shipping container. One method of the disclosed technology is a method of constructing a structural wall by performing the following steps.

The first step is securing a planar panel of EPS (expended polystyrene foam, or Styrofoam), the panel has a width and length and height, with the length being the longest dimension. The panel of EPS also has an interior side and an external side, and a top edge, a bottom edge, a left edge and a right edge, with the edges forming a perimeter around the EPS panel;

The second step is securing a metal panel to be sandwiched between two layers of EPS. The panel has a width and length and height, with the length being the longest dimension. The panel has an interior side and an exterior side, and a metal panel top edge, a metal panel bottom edge, a metal panel left edge and a metal panel right edge.

The next step is cutting the planar panel of EPS between the first and second side of the EPS panel, with the cutting step forming a kerf comprised of a profile matching any flats and valleys and protrusions and depressions found on said metal panel. A kerf is the gap in a material after it is cut, typically by a blade or other cutting tool. The cutting step forms an interior and an exterior EPS panel for contour matching and attachment to the interior side and the exterior side of the metal panel;

The interior panel of EPS is attached to the interior side of the metal panel using an adhesive; and the exterior panel of EPS is attached to the exterior side of the metal panel using an adhesive, thus forming a structural wall.

The method described above can be carried out using a metal panel which contains angular channels or corrugations extending between said metal panel top edge and said metal panel bottom edge.

The method of the disclosed technology can also be carried out with two EPS panels (not cutting on in half). In such case, each EPS panel has one flat side and one side with corrugations matching the corrugations of the corrugated metal panel.

The method of the disclosed technology can be applied to the corrugated metal wall of a shipping container as the metal panel, combined with the steps of securing a panel of EPS, cutting down the middle to match the corrugations of the metal panel, and attaching the interior panel and exterior panel of EPS to said metal panel interior and said metal panel exterior side. When the corrugated-on-one-side EPS panels are combined with the corrugated metal of the shipping container, a three layer structural wall without internal voids is formed. No penetrations in the metal panel are required, and no cavities are left for possible accumulation of humidity, mold, and moisture.

DEFINITIONS

Figure 1:
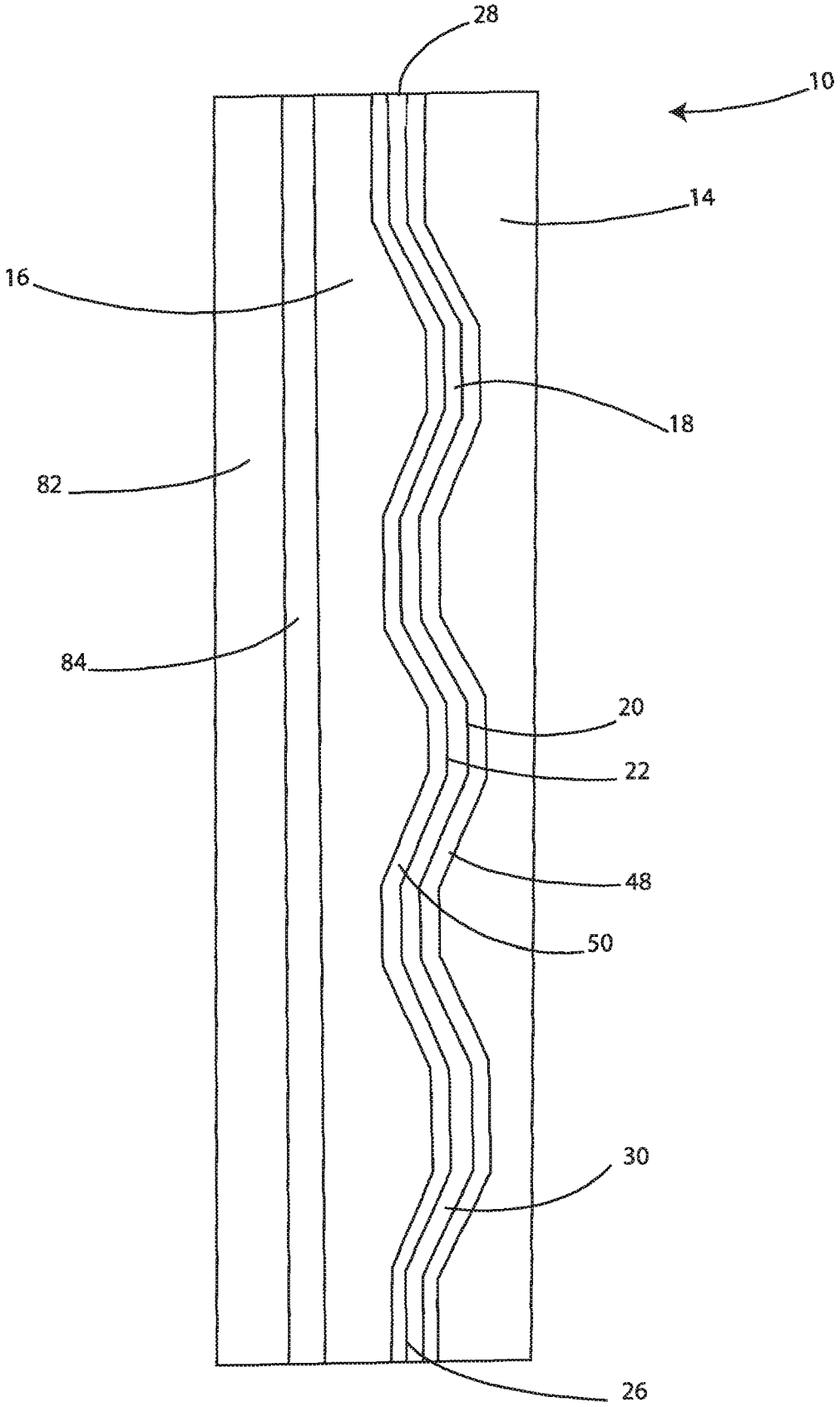
FIG. 1 is a top view of the structural wall.

In the following description and in the figures, like elements are identified with like reference numerals.

The use of "e.g.," and "or" indicates non-exclusive alternatives without limitation unless otherwise noted.

The use of "including" means "including, but not limited to," unless otherwise noted.

DETAILED DESCRIPTION OF THE PREFERRED EMBODIMENTS

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Certain preferred embodiments of the disclosed technology are shown in FIGS. 1 through 13.

Disclosed in FIG. 1 is a top view of the structural wall (10). In the preferred embodiment is the interior side (14) after it is cut and separated from the external side (16). The interior side (14) and the external side (16) originally come in one planar block of EPS (12). A kerf (38) is used to separate the planar block of EPS (12) into a first side (34) and a second side (36). The kerf (38) is shaped depending on the shape of the metal panel (18).

In the preferred embodiment, the metal panel (18) consists of a plurality of corrugations (66). The interior side (14) and the external side (16) are specifically cut to match the corrugations (66) of the metal panel (18). The interior side (14) is attached to the metal panel (18) using an internal adhesive (48). The external side (16) is attached to the metal panel (18) using an external adhesive (50). A siding adhesive (84) is used attach the outer side (16) with the decorative siding (82). The decorative siding (82) is generally flat and is the outermost surface of the structural wall (10) if used. The decorative siding (82) is an optional feature.

Figure 2:
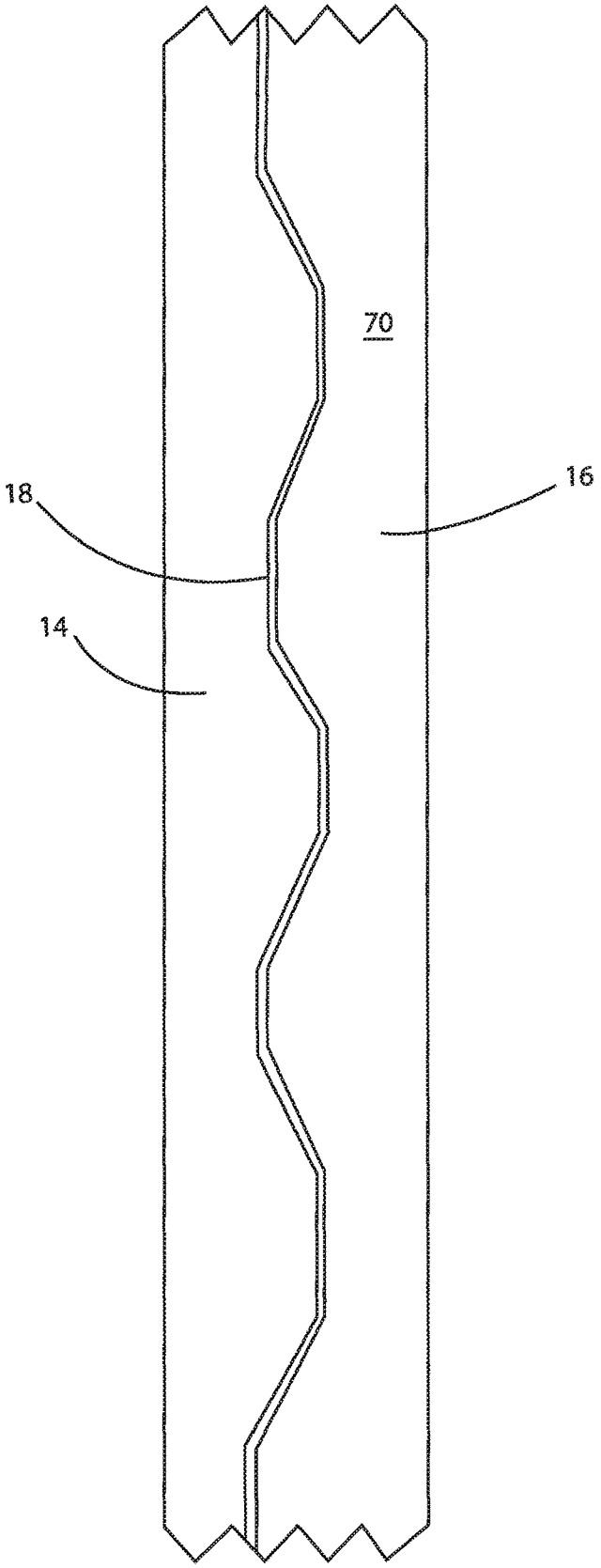
FIG. 2 is a top view of the assembled structural wall.

FIG. 2 is a top view of the assembled structural wall. Shown is the preferred embodiment of the step of securing the panel of EPS to a wall (70). Shown is the interior side (14) coupled with the metal panel (18), and the external side (16) to form the structural wall (10).

Figure 3:
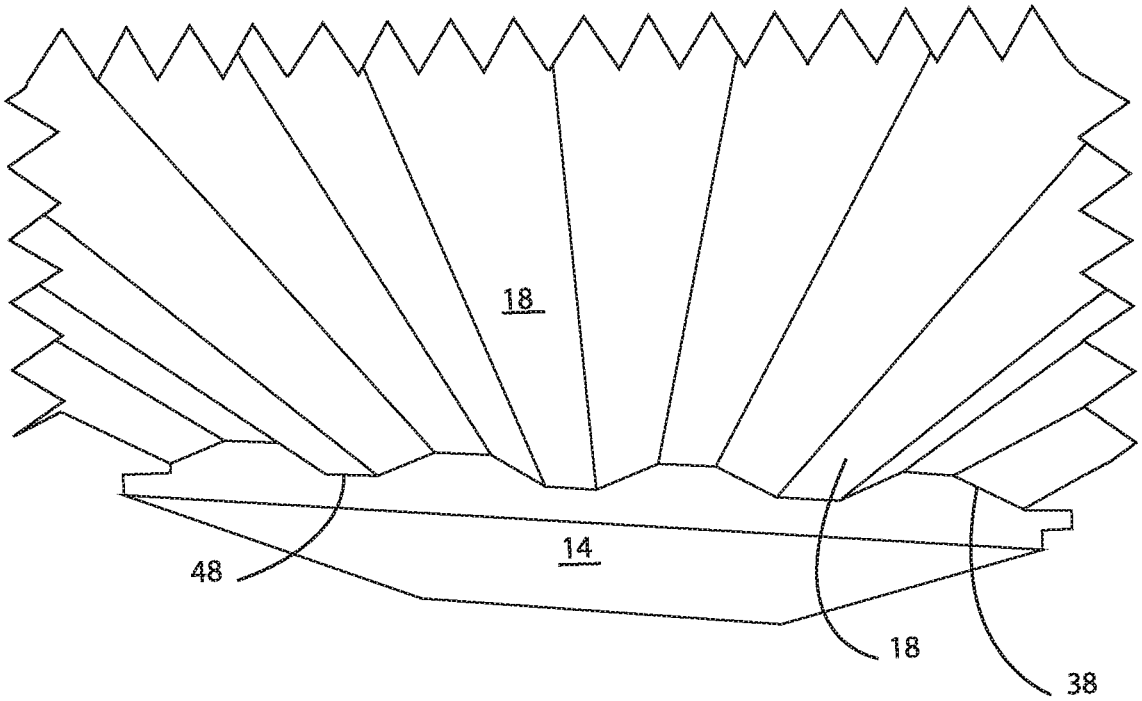
FIG. 3 is a top front perspective of a partial assembled view of the interior panel coupled to the metal panel.

FIG. 3 is a top front perspective view of a partially assembled interior side (14) coupled to metal panel (18). In the preferred embodiment, the interior side (14) and the external side (16) which is not shown in FIG. 3 will appear flush with the metal panel (18). An interior adhesive (48) and an external adhesive (50) will be applied to the kerf (38) of each side and the metal panel (18). The interior adhesive (48) and the external adhesive (50) will couple the interior side (14) with the metal panel (18), and the external side (16) with the metal panel (18).

Figure 4:
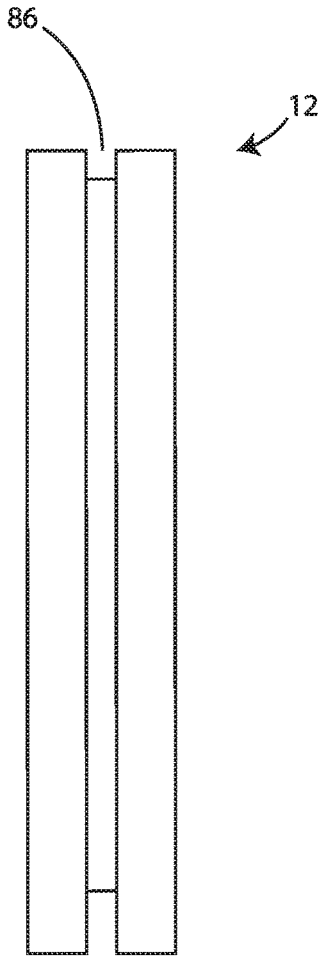
FIG. 4 is a top view of the planar panel of EPS.

FIG. 4 is a top view of the planar panel of EPS. Shown is the planar panel (12) prior to cutting said planar of EPS (32) using a cutting tool (86). The cutting tool (86) can be a laser or hotwire, or any other means to cut EPS known in the industry.

Figure 5:
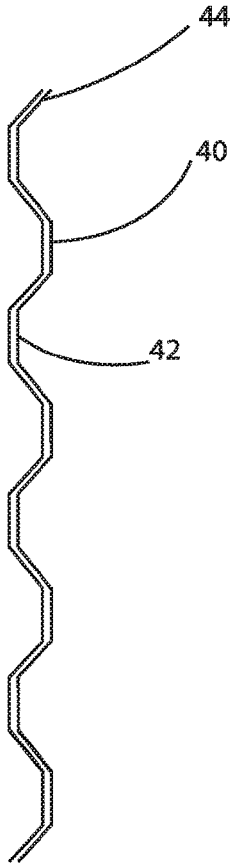
FIG. 5 is a top view of the step of cutting profile matching any flats and valleys and protrusions and depressions found on metal panel.

FIG. 5 is a top view of the step of cutting (32) profile matching any flats (40) and valleys (42) and protrusions (44) and depressions (46) found on metal panel (18).

Figure 6:
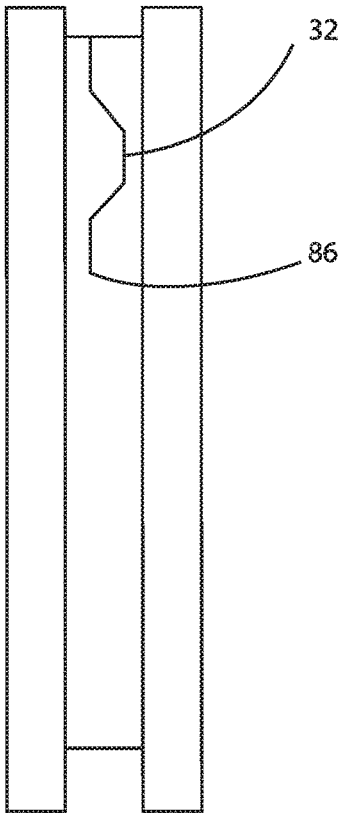
FIG. 6 is a top view of cutting planar panel of EPS.

FIG. 6 is a top view of cutting the planar panel of EPS (32). In a preferred embodiment, the cutting tool (86) is moved through the inner surface of the planar panel (12) in a pattern matching the corrugations (66) of the metal panel (18).

Figure 7:
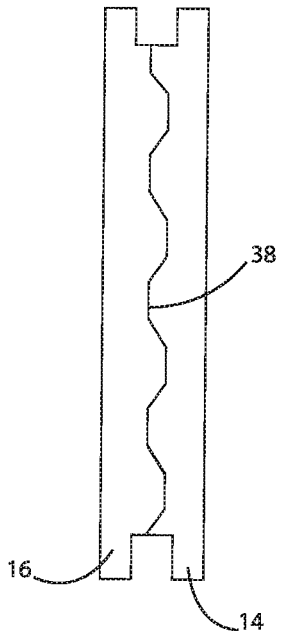
FIG. 7 is a top view of a planar panel of EPS with kerf.

FIG. 7 is a top view of a planar panel of EPS with kerf. Shown is the preferred embodiment, which displays the kerf (38) after the cutting tool (86) has cut the planar panel of EPS (12) which corresponds with the corrugations (66) of the metal panel (18). The planar panel of EPS (12) is now divided into an interior side (14) and an eternal side (16).

Figure 8:
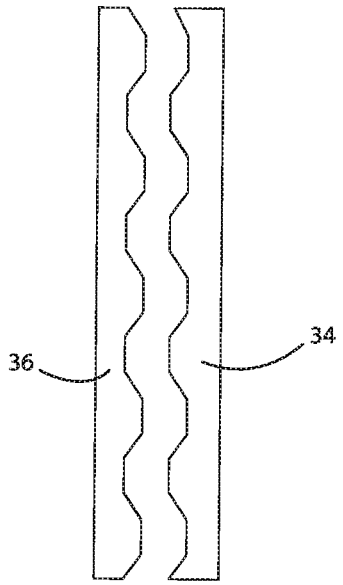
FIG. 8 is a top view of the interior side and external side of planar panel of EPS.

FIG. 8 is a top view of the interior side (14) and external side (16) of planar panel of EPS. The kerf (38) has divided the planar panel of EPS (12). The flats (40) and valleys (42) and protrusions (44) and depressions (46) match the metal panel (18) for which the planar panel of EPS (12) was designed.

Figure 9:
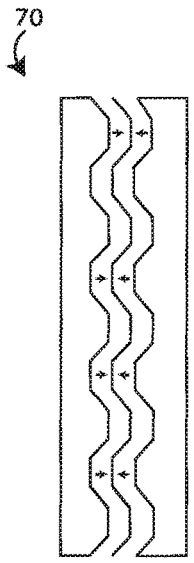
FIG. 9 is a top view of the step of securing planar panel of EPS to a wall.

FIG. 9 is a top view of the step of securing planar panel of EPS to a wall (70). In the preferred embodiment, the interior side (14) and the external side (16) are secured around a metal panel (18) using an internal adhesive (48) and an external adhesive (50) applied to the kerf (38) to form the structural wall (10).

Figure 10:
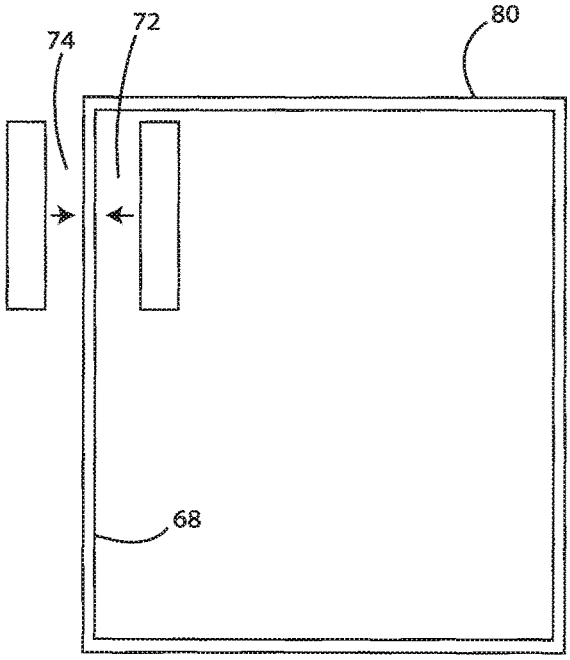
FIG. 10 is a rear view of the step of securing planar panel of EPS to a wall where the wall is a shipping container.

FIG. 10 is a rear view of the step of securing planar panel of EPS to a wall (70) where the wall is a shipping container (80). In the preferred embodiment, the step of securing a first planar panel of EPS to a wall (72) and the step of securing a second planar panel of EPS to a wall (74) in combination where the wall is a metal panel (18) form the structural wall (10). Shown is the step of securing a first planar panel of EPS to a wall (72) and the step of securing a second planar panel of EPS to a wall (74) where the metal panel (18) is a shipping container wall (68).

Figures 11, 12, 13:
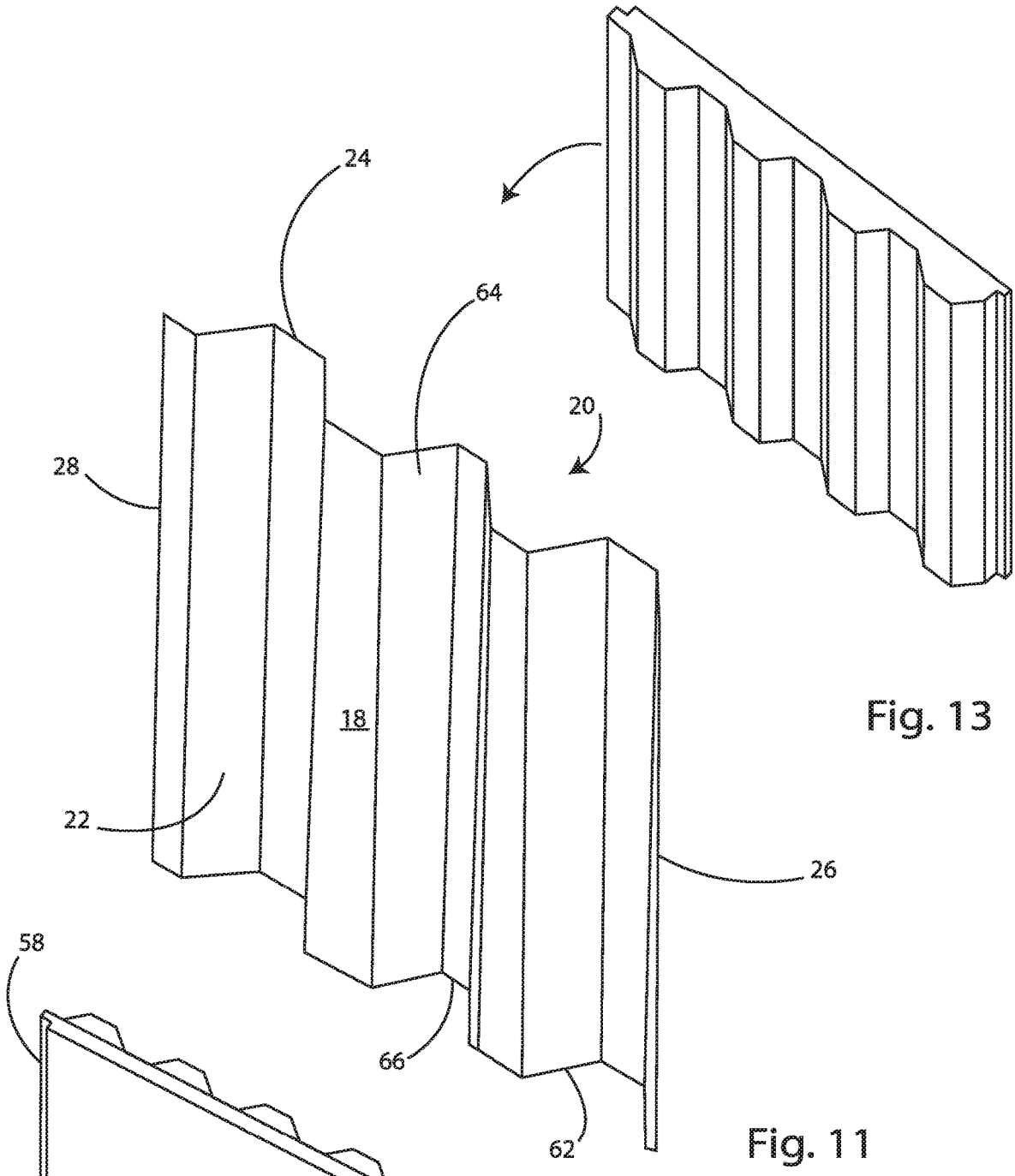
FIG. 11 is a perspective view of a metal panel.
FIG. 12 is a perspective view of an external side.
FIG. 13 is a perspective view of an interior side.

FIG. 11 is a perspective view of a metal panel (18). Shown is the preferred embodiment displaying a metal panel interior side (20), metal panel exterior side (22), metal panel top edge (24), metal panel left edge (26), metal panel bottom edge (62), and a metal panel right edge (28). In the preferred embodiment there are corrugations (66) in the metal panel (18).

FIG. 12 is a perspective view of an external side (16). In the preferred embodiment, there is a left edge (56), right edge (58), top edge (52), and bottom edge (54). The edges for a perimeter (60).

FIG. 13 is a perspective view of an interior side (14). The kerf (38) is cut using the cutting tool (86) that match the corrugations (66) of the metal panel (18).

I claim:

1. A method of constructing a structural wall comprising the steps of:

securing a planar panel of EPS, said panel of EPS having a width and length and height, with the length being the longest dimension, with an interior side and an external side, and a top edge, a bottom edge, a left edge and a right edge, said edges forming a perimeter around said panel of EPS;

securing a metal panel, said metal panel having a width and length and height, with the length being the longest dimension, said metal panel having a metal panel interior side and a metal panel exterior side, and a metal panel top edge, a metal panel bottom edge, a metal panel left edge and a metal panel right edge, for forming an inner layer of said structural wall;

cutting said planar panel of EPS between said interior side and exterior side of said planar panel of EPS, with said cutting step forming a kerf comprised of a profile matching any flats and valleys and protrusions and depressions found on said metal panel, said cutting action forming an interior EPS panel and an exterior EPS panel for counter matching attachment to said interior side and said exterior side of said metal panel;

attaching said interior panel of EPS to said interior side of said metal panel using an adhesive; and attaching said exterior panel of EPS to said exterior side of said metal panel using an adhesive, forming a structural wall.

2. The method of claim 1 in which said step of securing a metal panel further comprises securing a metal panel comprised of angular channels extending between said metal panel top edge and said metal panel bottom edge, with said channels forming corrugations on said metal panel interior and said metal panel exterior sides;

with said step of cutting said EPS forming a kerf between said interior and exterior panels comprises cutting said kerf in a shape corresponding to said angular channels of said metal panel.

3. A method of constructing a structural wall comprising the steps of:

securing a planar panel of EPS, said planar panel of EPS having a width and length and height, with the length being the longest dimension, with an interior side and an exterior side, and a top edge, a bottom edge, a left edge and a right edge, said edges forming a perimeter around said planar panel of EPS;

securing a metal panel, said metal panel having a width and length and height, with the length being the longest dimension, said metal panel having a metal panel interior side and a metal panel exterior side, and a metal panel top edge, a metal panel bottom edge, a metal panel left edge and a metal panel right edge, for forming an inner layer said structural wall, said metal panel comprised of angular channels extending between said metal panel top edge and said metal panel bottom edge, with said channels forming corrugations on said metal panel interior and said metal panel exterior sides;

cutting said planar panel of EPS between said interior side and exterior side of said planar panel of EPS, with cutting said EPS panel between said interior and exterior sides of said planar panel of EPS in a shape corresponding to said angular channels of said metal panel, with said cutting forming a kerf comprised of a profile matching any flats and valleys and protrusions and depressions found on said metal panel, said cutting action forming an interior and an exterior EPS panel for contour matching engagement and attachment to said interior side and said exterior side of said metal panel;

attaching said interior panel of EPS to said interior side of said metal panel using an adhesive; and attaching said exterior panel of EPS to said exterior side of said metal panel using an adhesive, forming a structural wall.

4. The method of constructing a structural wall of claim 3 which further comprises the step of using a corrugated metal wall of a shipping container as the metal panel, combined with the steps of securing a panel of EPS, cutting down the middle to match the corrugations of said metal panel, and attaching said interior panel and exterior panel of EPS to said metal panel interior and said metal panel exterior side.

5. A method of constructing a structural wall comprising the steps of:

securing a metal panel, said panel having a width and length and height, with the length being the longest dimension, said metal panel having a metal panel interior side and a metal panel exterior side, and a metal panel top edge, a metal panel bottom edge, a metal panel left edge and a metal panel right edge, for forming an inner layer said structural wall, said metal panel comprised of angular channels extending between said metal panel top edge and said metal panel bottom edge, with said channels forming corrugations on said metal panel interior and said metal panel exterior sides;

securing a planar first panel of EPS, said first panel of EPS having a width and a length and a height, with the length being the longest dimension, with said first panel of EPS having an interior side with corrugations corresponding to corrugations of said interior side of said metal panel, and said first panel of EPS having an exterior side with a planar surface, said first panel of EPS with a top edge, a bottom edge, a left edge and a right edge, said edges forming a perimeter around said panel;

securing a planar second panel of EPS, said second panel of EPS having a width and length and height, with the length being the longest dimension, with said second panel of EPS having an interior side with corrugations corresponding to corrugations of said exterior side of said metal panel, and an external side of said second panel of EPS with a planar surface, said second panel of EPS with a top edge, a bottom edge, a left edge and a right edge, said edges forming a perimeter around said second panel of EPS;

attaching said interior side of said first panel of EPS to said interior side of said metal panel using an adhesive; and attaching said interior side of said second panel of EPS to said exterior side of said metal panel using an adhesive, forming a structural wall.

6. The method of constructing a structural wall of claim 3 which further comprises the step of using a corrugated metal wall of a shipping container as the metal panel, combined with the steps of securing a first and second panel of EPS, each with corrugations to match those of said metal panel, and attaching said first EPS and second EPS panel to said metal panel interior and said metal panel exterior side, thus forming a three layer structural wall without internal voids.

* * * * *